United States Patent [19]

Wendt et al.

[11] 3,998,027

[45] Dec. 21, 1976

[54] DECORATIVE RUNNER AND WALL

[75] Inventors: Alan C. Wendt, Barrington; Nels Nelsson, Des Plaines, both of Ill.

[73] Assignee: United States Gypsum Company, Chicago, Ill.

[22] Filed: June 8, 1972

[21] Appl. No.: 263,351

[52] U.S. Cl. ..... 52/716; 52/211; 52/242

[51] Int. Cl.[2] ..... E04B 2/74

[58] Field of Search ..... 52/238, 241, 242, 290, 52/243, 215, 254, 288, 287, 732, 716

[56] References Cited

UNITED STATES PATENTS

| | | | |
|---|---|---|---|
| 1,990,259 | 2/1935 | Walters | 52/242 |
| 2,569,896 | 10/1951 | Mayes | 52/290 |
| 3,309,826 | 3/1967 | Zinn | 52/241 |
| 3,339,324 | 9/1967 | Stackhouse | 52/241 |
| 3,623,290 | 11/1971 | Downing | 52/241 |

FOREIGN PATENTS OR APPLICATIONS

| | | | |
|---|---|---|---|
| 1,011,890 | 12/1965 | United Kingdom | 52/716 |
| 1,075,302 | 7/1967 | United Kingdom | 52/716 |

OTHER PUBLICATIONS

Sweet's Catalog, 1971 Brochure a/1291, pp. 1–8.

*Primary Examiner*—John E. Murtagh
*Attorney, Agent, or Firm*—Donnie Rudd; Samuel Kurlandsky; Robert H. Robinson

[57] ABSTRACT

An improved ceiling runner and wall constructed therefrom wherein the exterior, decorative flange holding in place the wallboard of the wall is provided with means for removably engaging a decorative trim which may be added to alter the decorative appearance.

3 Claims, 5 Drawing Figures

DECORATIVE RUNNER AND WALL

BACKGROUND OF THE INVENTION

A great variety of ceiling runners have been provided for mounting wallboard, usually spaced transversely apart, in a wall. The functions all of these runners have in common is to connect the top of the wall to the ceiling or ceiling surface and to present a finished surface exposed to the room or space formed by the wall. To do this, they must have a stop means which horizontally positions the wallboard, and a member which depends downwardly over the top edge of the wallboard to cover the ragged, unesthetically appealing, edges of the wallboard. Other factors which compound the problem are that ceiling irregularities require a runner construction which, in meeting the aforesaid two functions, draws attention away from the actual exposed junction of the ceiling with the vertical surface of the runner. Also, the runner must accommodate other wall parts, such as doorstop headers.

Fairly recent constructions have been provided which constitute a first solution to the above-stated requirements. The runner disclosed in U.S. Pat No. 3,508,364 is an example of the type which utilizes separate elements to meet these requirements. That is, the depending flanges thereof terminate in an upturned edge which abuts against the upper flanges of wallboard panels placed exteriorly thereto. Clips are used to hold the abutting edge and flanges together, and to cover this up, decorative trim which draws attention away from the ceiling-wall junction is snapped over the clipped edges and extends back up towards the ceiling. While such a construction has the advantage of providing a variety of decorative trims which are interchangeable, in no case can the trim be eliminated altogether.

The runner disclosed in U.S. Pat. No. 3,339,324 is an example of the type wherein the same exterior flange provides both of these functions. However, such a runner has the disadvantage that the only convenient way of changing its appearance is to paint it. This method is time-consuming and does not encompass a change of materials such as vinyl or fabric. No decorative trim is provided in conjunction with the runner.

SUMMARY OF THE INVENTION

The invention relates to an improved ceiling runner characterized by an external wallboard-stopping flange which is both esthetically appealing itself and permits the use of interchangeable decorative trim which is readily mounted thereover. More specifically, there is provided an improved ceiling runner for wallboards, and wall constructed therefrom, the runner including a ceiling mounting portion and stop means for locating the wallboard in proper position; the improvement comprising a first exteriorly finished flange extending from the mounting portion and formed with an offset and a depending decorative portion terminating in an edge incorporating the stop means, and further including a trim element removably mounted on said flange. Preferably, a shoulder extends upwardly from the decorative portion to create a shadow line, and the trim is snapped over it.

Accordingly, it is an object of the invention to provide an improved ceiling runner and wall constructed therefrom, wherein the exterior flange that positions the wallboard has both a finished, decorative appearance itself and has the capability of removably accommodating thereover a decorative trim.

It is a related object of the invention to provide such a runner and wall wherein the decorative flange is shaped to create a shadow line on the upper portion of the runner.

It is another object of the invention to provide such a runner and wall wherein a doorstop header can be readily accommodated by the runner without additional clips.

Other objects and advantages will become apparent upon reference to the following drawings and detailed discussion.

DESCRIPTION OF THE PREFERRED EMBODIMENTS

The invention concerns a ceiling runner and wall constructed therefrom, which may be used in a great variety of structures to permit a variety of decorative wall surfaces positioned adjacent to the ceiling. Preferably, the runner is used in conjunction with wallboard, which may be gypsum or otherwise, and which may have any kind of finish desired.

All orientations hereinafter used, such as "upward" or "depending", refer to the assembled configuration of the components of the invention.

Figure 1:
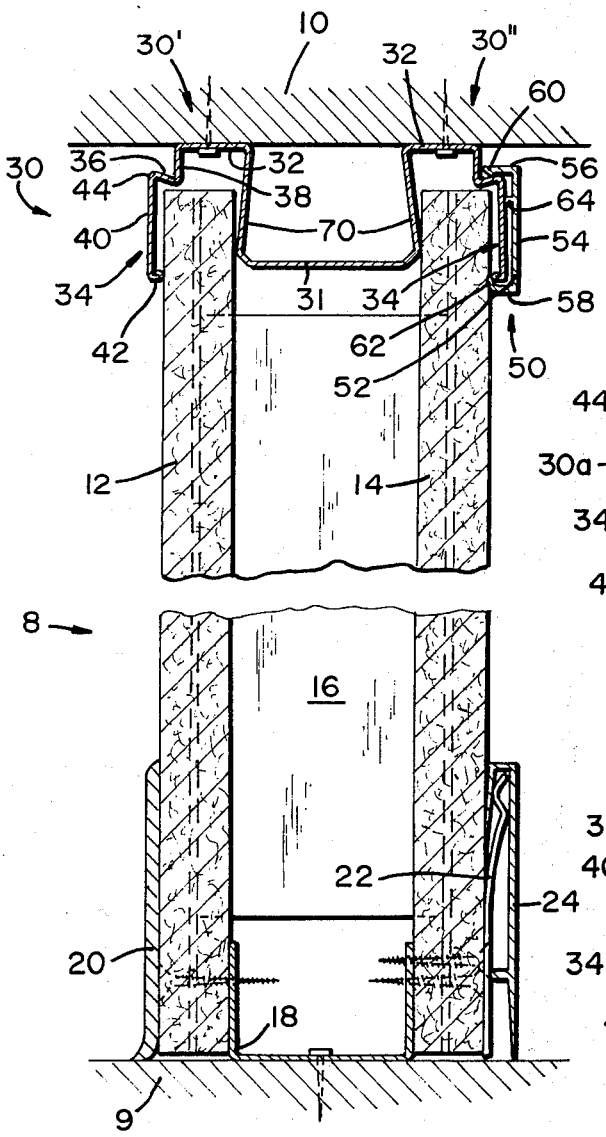
FIG. 1 is a fragmentary elevational view in section of a wall constructed using the runner of the invention.

FIG. 1 illustrates a wall 8 extending from floor 9 to ceiling 10, constructed with the runner 30 of the invention, and incorporating conventional gypsum wallboards 12 and 14 spaced apart by the runner and by a floating stud 16 which may be of any convenient design. As shown, the wall is demountable, the base of the wall being conventionally constructed by screw-attaching the wallboard to a floor runner 18. A vinyl or rubber base trim 20 may be adhesively attached to wallboard 12 or a base clip 22 may be screw-attached to floor runner 18 to accommodate a conventional aluminum or vinyl trim 24 thereover. The latter is preferred for walls having a decorative trim 50 mounted thereabove on the ceiling runner as described below, because of the greater relief provided.

Figure 2:
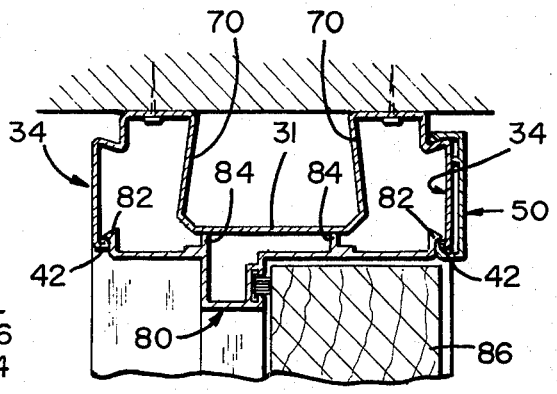
FIG. 2 is a fragmentary elevational view similar to FIG. 1 but taken through the door portion of the wall.

In accordance with one aspect of the invention, the runner 30 shown in FIGS. 1 and 2 comprises two halves 30' and 30'' joined by web 31, which halves are mirror images of each other, having a longitudinal plane of symmetry extending along the midpoint of the runner. Each half thus comprises a ceiling mounting portion 32 attached to the ceiling by means such as screws, and a flange 34 extending in a depending fashion from the runner, the flange being provided with an offset 36 dividing it into a ceiling portion 38 and a decorative surface 40. Surface 40 terminates in a wallboard stop or restraining means comprising the edge 42 of the flange, preferably turned over. The offset 36 extends generally upward back towards the ceiling, forming an upwardly projecting shoulder 44 at its junction with the decorative surface 40. The shoulder 44 thus creates a shadow line against ceiling portion 38. Because of the linearity of shoulder 44, this shadow line is regular and sharply defined, hiding any ceiling irregularities that might appear if the actual junction of portion 38 with the ceiling were clearly exposed. This function is further enhanced by preferably decorating portion 38 with a flat black color, while surface 40 is given a highlight color or surface compatible with the decorative theme of the wall. For example, surface 40 might be finished with a vinyl film of any desired color.

As shown particularly with regard to half 30'', each flange 34 may accommodate a decorative trim 50 removably mounted thereover to cover the decorative surface 40. Specifically, the trim is provided with a body portion 52 having a decorative surface 54 and terminating in generally horizontal flanges 56 and 58 which extend generally perpendicularly from the body portion. Each flange in turn terminates in edges 60 and 62, respectively. Edge 60 is characterized by a shoulder or rib especially adapted to engage the shoulder 44, while edge 62 is turned over to extend under itself and the stop edge 42 of the runner flange. The engagement of shoulder 60 with shoulder 44 insures that the trim terminates vertically short of the ceiling, no higher than is necessary to engage shoulder 44 with the trim, to create a shadow line similar to the effect of shoulder 44. A reinforcing rib or engagement stop 64 may extend from the body into contact with decorative surface 40.

Thus, trim 50 may be readily added or removed, to vary the decorative appearance of the flange 34. To this end, a variety of decorative surfaces 54 are provided on a plurality of such trims, including a variety of painted colors, textures, or even exposed body metal such as aluminum or stainless steel.

As shown, a ceiling runner may have a trim 50 engaging one half 30'', while leaving the other half 30' uncovered with decorative surface 40 exposed, as dictated by the design requirements of individual rooms.

In accordance with another aspect of the invention, each half 30' and 30'' is provided with a second flange 70 depending from portion 32, the flange 70 terminating at a junction with web 31. The web 31 and flanges 70 have two functions as best seen in FIGS. 1 & 2 - to hold the wallboards 12 and 14 against the stop edges 42, and to hold a doorstop header 80 in place from vertical disengagement from the ceiling runner. More specifically, the door stop header 80, otherwise conventional, has been provided with lips 82 for supporting the header on the stop edges 42, and with shoulders 84 which rise from the header to press against the web portion 31. This keeps the header in place to stop the door 86, without requiring any permanent attachment of the header to the runner.

Figure 3:
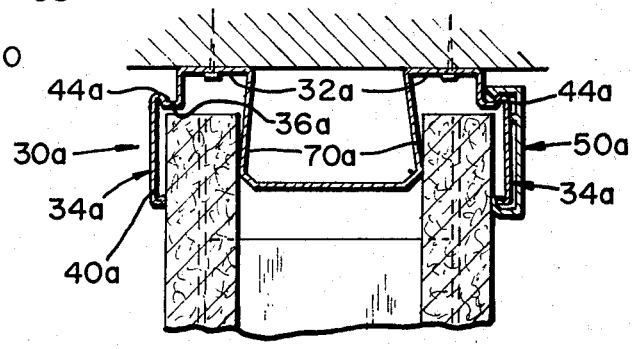
FIG. 3 is a fragmentary, elevational view similar to FIG. 1 but illustrating an alternate embodiment of the invention.

FIG. 3 illustrates an alternate embodiment of the invention wherein the offset has been modified to provide a more pronounced shadow-creating shoulder. Parts similar to those previously described bear the same reference numeral to which the distinguishing suffix *a* has been applied. Thus, ceiling runner 30*a* has two halves as before, each comprising a ceiling mounting portion 32*a* and depending flanges 34*a* and 70*a*. Flange 34*a* and decorative trim 50*a* removably mounted thereover are identical to the previous embodiment except that the offset 36*a* extends generally parallel to the ceiling mounting portion, and perpendicular to the plane of the wall. This produces a more pronounced shoulder 44*a* at the junction of the offset with decorative surface 40*a*, thus creating a more positive engagement with the trim 50*a*.

Both the embodiment of FIGS. 1 and 2, and that of FIG. 3, are preferably roll-formed from metal such as steel.

Figure 4:
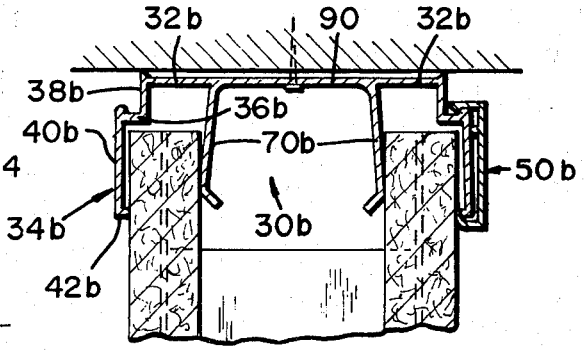
FIG. 4 is a fragmentary elevational view in section similar to FIG. 1 but illustrating still another alternate embodiment of the invention.
Figure 5:
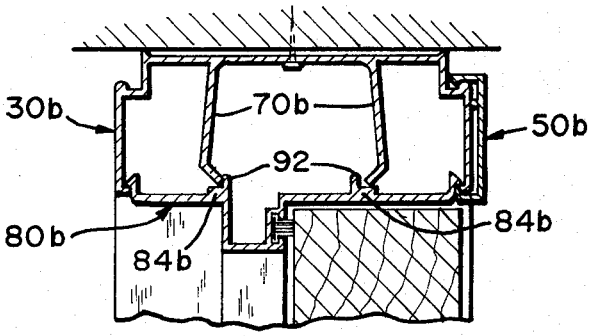
FIG. 5 is a fragmentary elevational view similar to FIG. 2 but illustrating the embodiment of FIG. 4.

FIGS. 4 and 5 illustrate yet another embodiment wherein the ceiling runner has been extruded, preferably from a metal such as aluminum. Parts similar to those previously described bear the same reference numeral, to which the suffix *b* has been added. Thus, as before, the runner 30*b* comprises two halves which are mirror images, each half having a mounting portion 32*b* and a depending flange 34*b* provided with an offset 36*b*, ceiling portion 38*b*, decorative surface 40*b*, and stop edge 42*b* which are essentially identical to the previous embodiment. Trim 50*b* may removably engage either or both flanges 34*b* as before. The primary difference is that flanges 70*b* do not join together in a web at their lower portions, but rather a web 90 joins the two halves as an extension of the upper terminal edges of flanges 70*b* and of the ceiling mounting portions. This means that, as shown in FIG. 5, the flanges 70*b* must prevent the doorstop header 80*b* from being vertically disengaged from flanges 30*b*. This is accomplished by means of the shoulders 84*b* which are raised from the header, lips 92 being optional to further limit the flanges from slipping off the shoulders.

Although the invention has been described in connection with certain preferred embodiments, it will be recognized that it is not limited thereto. For example, an additional use to which the runner is adaptable in all the embodiments, when left uncovered, is as a picture mold. Thus, it is intended that it include all alternate arrangements, equivalents, and embodiments as may be included within the scope of the following claims.

What is claimed is:

1. In a ceiling runner for holding wallboards spaced apart in a wall, the runner including a ceiling mounting portion and restraining means for holding the wallboard in proper position; the improvement comprising at least one flange having a portion extending downwardly from said mounting portion, a portion connected to said downwardly extending portion extending outwardly and upwardly to form a shadow-creating shoulder offset from said downwardly extending portion, a downwardly extending decorative surface portion connected to said shoulder adapted to be spaced apart from the wallboard surface and terminating at its lower portion in an inwardly directed flange acting as a restraint against a wallboard mounted in said runner against outward movement, and a downwardly-directed trim element removably mounted over said flange and extending from said shoulder said inwardly directed flange, said trim element having a sheet-form body, a flange at its upper edge provided with detent means adapted to engage said shoulder, and an inwardly directed flange at the bottom edge of said trim element having an upturned edge engaging said decorative surface, said trim element being detachably affixed to said decorative surface by the clamping action of the upper and lower flanges of said trim panel against the shoulder and lower flange of said decorative surface and further including a door stop header supported by said inwardly directed flange.

2. The improved runner as defined in claim 1, and further including at least a second flange depending from said mounting portion spaced from said one flange a distance which will accommodate between said flanges one of said wallboards, said header being characterized by means of preventing said header from being vertically disengaged from said inwardly directed flange.

3. The improved runner as defined in claim 2, wherein said header includes at least one raised portion abutting against the end of said second flange.

* * * * *